US005554267A

United States Patent [19]

Grossmann et al.

[11] Patent Number: 5,554,267

[45] Date of Patent: Sep. 10, 1996

[54] WIRE SECTION OF A MACHINE FOR MAKING FIBROUS MATERIAL WEBS

[75] Inventors: Udo Grossmann, Heidenheim; Werner Eckl, Bachhagel, both of Germany

[73] Assignee: J. M. Voith GmbH, Heidenheim, Germany

[21] Appl. No.: 287,212

[22] Filed: Aug. 8, 1994

[30] Foreign Application Priority Data

Aug. 11, 1993 [DE] Germany ..... 43 26 867.6

[51] Int. Cl.[6] ..... D21F 1/00; D21F 1/48

[52] U.S. Cl. ..... 162/301; 162/272; 162/300

[58] Field of Search ..... 162/272, 300, 162/301, 352

[56] References Cited

U.S. PATENT DOCUMENTS

| | | | |
|---|---|---|---|
| 4,146,424 | 3/1979 | Justus | 162/301 |
| 4,414,061 | 11/1983 | Trufitt | 162/301 |
| 4,523,978 | 6/1985 | Pullinen | 162/301 |
| 4,623,429 | 11/1986 | Tissari | 162/301 |
| 5,045,153 | 9/1991 | Sollinger | 162/301 |

FOREIGN PATENT DOCUMENTS

| | | |
|---|---|---|
| 0373133 | 6/1990 | European Pat. Off. . |
| 0397430 | 11/1990 | European Pat. Off. . |
| 315633 | 6/1974 | Germany . |
| 4005420 | 8/1991 | Germany . |

*Primary Examiner*—Karen M. Hastings
*Attorney, Agent, or Firm*—Baker & Daniels

[57] ABSTRACT

A wire section of a machine for making a fiber web, with two continuous wires forming together a twin-wire zone. A dewatering element is pressable on the inside of the wire with at least one surface. The dewatering element features in the direction of travel of the fiber suspension, in interaction with the wires, two dewatering zones. The first dewatering zone is defined by an essentially flat surface, while a second dewatering zone is defined by a surface curving about an axis of curvature in the direction of travel of the fiber suspension. Coordinated with the dewatering element are at least two support axes on which support elements are arranged. Coordinated with the dewatering element is a pivot axis. The pivot axis is stationary as regards the tilting operation, and extends parallel to the separation plane between the first and second dewatering zones and parallel to the wire. The pivot axis is arranged in the area of the axis of curvature.

4 Claims, 3 Drawing Sheets

WIRE SECTION OF A MACHINE FOR MAKING FIBROUS MATERIAL WEBS

BACKGROUND OF THE INVENTION

The invention concerns a wire section of a machine for making fibrous material webs of the type with two continuous wires forming together a twin-wire zone, and with a dewatering element which can be pressed on the inside of the wire with at least one surface. The dewatering element features in the direction of travel of the fiber suspension, in interaction with the wires, two dewatering zones. The first dewatering zone is defined by an essentially flat surface, while a second dewatering zone is defined by a surface curving about an axis of curvature in the direction of travel of the fiber suspension. Coordinated with the dewatering element are at least two support axes on which support elements are arranged. Also, coordinated with the dewatering element is a pivot axis.

Twin-wire formers of this type are known from (1) DE 40 05 420, (2) EP 0 397 430.

The twin-wire formers cited in these documents feature among others a dewatering unit consisting of a number of rigid slats bearing on the inside of the top wire and of flexibly arranged slats which are arranged on the inside of the bottom wire, essentially in the intermediate range of the slats bearing on the top wire.

The slats bearing on the inside of the top wire are preferably arranged on the underside of a dewatering box. The dewatering box is preferably equipped with a suction system for removal of the liquid issuing upwardly out of the fiber suspension. This box, or carrier for the slats bearing on the inside of the top wire, is coupled to essentially vertically movable support elements through which an adjustment, or positional change, of the box and also the positional change of the top wire relative to the bottom wire, for adaptation to different layer thicknesses, can be accomplished, since normally the top wire always is being moved along with the box. That is, the area swept by the slats on the inside of the top wire remains maximally constant.

The arrangement of the slats on the underside of the dewatering box, or on a carrier, can be subdivided in two areas, in keeping with the profile contour deriving thereof. In cooperation with at least one continuous wire, one speaks of two dewatering zones. Viewed in profile, the row of slats can describe an essentially straight stretch and/or a curved stretch. The underside of the dewatering box, or carrier, can then as well have this shape. A straight slat arrangement is often combined with a curved one.

In DE 40 05 420, the box features in its upper area relative to the inside of the top wire, e.g., pivot bearings which are coupled to essentially vertically movable support elements. The position of the pivot bearings is chosen such that two first ones, in the direction of travel of the fiber suspension, are arranged in the area of the front, lateral outside edge of the box and two second ones in the area of the rear outside edges of the box. The front and rear pivot bearings are situated each on a pivot axis. A sole positional change of the pivot axis of the front pivot bearings, i.e., adjustment of the front support elements, causes the dewatering box to pivot, or tilt, about the pivot axis of the rear pivot bearings.

The twin-wire former known from EP 0 397 430 comprises an upper and lower wire loop which together form within an area a twin-wire zone. Within this twin-wire zone there is a dewatering unit provided, which serves to dewater the fiber suspension. Here, too, the dewatering unit is formed by an arrangement of slats, with a number of rigidly arranged slats working against the inside of the top wire, whereas a number of flexibly arranged slats work in staggered fashion against the inside of the bottom wire.

The slats bearing on the inside of the top wire describe in profile, relative to the direction of web travel, a straight stretch with a following curvature. Consequently, the underside of the top wire box, or slat support element, may be of a design analogous to this shape.

Due to the necessity of changing the slat pressure for adaptation to different layer thicknesses, the upper part of the dewatering unit tilts about a pivot axis which is situated either exactly on the section line of the separating plane of the two dewatering zones with the underside of the upper part of the dewatering unit, or is situated in the curved area of this part of the dewatering unit parallel to the separating plane between the dewatering zone with straight and curved design, on the curved surface of the underside of the upper part of the dewatering unit.

The disadvantage of these embodiments cited in DE 40 05 420 and EP 0 397 430, at layer thickness change, is constituted by the change of the departure line of the wires from top wire dewatering box, or support element for the rigid slats, which is associated with the deflection, and thus also by the change of the approach angle to the following suction separator, or to other wire guide units. Depending on the pivotal direction of the dewatering unit, the wires run over the edge of the last slat in the direction of web travel, or they run in such a fashion over the edge of a slat arranged, e.g., on the underside of the upper part of the dewatering the unit which, in the direction of web travel, is arranged essentially before the last slat, in a fashion such that not all of the suction slots of the upper part of the dewatering unit are covered anymore. That is, the slats in the area not covered by the wire are then situated on a shank of an acute angle which is defined by the underside of the upper part of the dewatering unit and a plane which in this area is described by the course of the wires, or the upper wire. Deposits may accumulate in this acute angle, which in the subsequent lowering, or restoration, of the upper part of the dewatering unit may lead to damage. These depositions have a negative effect also on the process of dewatering the fiber suspension.

The problem underlying the invention is to fashion the arrangement and positional change options of a dewatering element in such a way that the said disadvantages will be avoided, i.e., that the rear part of the dewatering element in the direction of travel, which describes a curved surface, performs in the adaptation of the entrance gap on the dewatering element to different layer thicknesses, by positional change of the dewatering unit, an only negligible up and down motion. That is, that for instance with a top wire dewatering box the top wire will not essentially depart from the last slat, or that the top wire will by the upper wire dewatering box not be pulled into a certain, undesirable angle. Moreover, the entrance gap is to allow a simple adjustment and maintenance.

SUMMARY OF THE INVENTION

This problem is overcome by the features of the present invention. In interaction with the at least one wire, the dewatering element forms in the running direction of the fiber suspension two dewatering zones, with the second one being described by a surface curving about an axis of curvature. Coordinated with the dewatering element are at least two support axes on which the elements for installation on the machine frame are arranged.

Owing to the inventional arrangement of the pivot axis, i.e., of a stationary axis about which pivots, or tilts, the dewatering element, in the area of the axis of curvature of the part of the dewatering element of curved design, preferably exactly on the axis of curvature, it is possible to accomplish that in the vertical lowering or raising, respectively tilting of the part of the dewatering element which in interaction with the at least one wire describes a flat surface respectively the just referenced dewatering zone, the part of the dewatering element describing a curved surface, or curved dewatering zone, turns about the pivot axis arranged in the area of the axis of curvature. Due to the position of the pivot axis in the area of the axis of curvature, the motion of the curved part of the dewatering element follows over a sufficiently long distance the circular arc described by the radius of curvature of the curved part. When the pivot axis coincides exactly with the axis of curvature, the curved part of the dewatering element follows in pivoting the circular arc described by the radius of curvature.

The layer thickness differences being normally not very large, the positional change of the straight part of the dewatering element required for adaptation is relatively slight. Consequently, also the tilt, or pivot, angle about the stationary pivot axis—and, associated with it, the path of the curved part of the dewatering element along the circle of an arc described by the radius of curvature—is relatively slight.

With the pivot axis arranged on the axis of curvature, the departure line of the wires on the dewatering element shifts at deflection only along the circle of arc described by the radius of curvature. With the pivot axis arranged in the area of the axis of curvature, the circle of arc described by the curved surface is in tilting or pivoting not identical with the circle of arc described by the radius of curvature. The pivot angles normally being very small, however, the resulting deviation of the described circles of arc from one another is negligibly small. If the departure lines of the wires from the dewatering element change at appropriately large deflection, the approach lines of the wires to the following wire guide units remain extensively unaffected thereby.

One of the at least two support axes on which the elements for mounting of the dewatering elements, or for support on the machine frame, are arranged is preferably configured as stationary pivot axis with regard to the tilting process. The advantage of this is that only the position of the other support axle needs to be changed for tilting the dewatering element, whereas otherwise both support axles must be shifted, or varied in their position, in such a way that the dewatering element turns about a stationary pivot axis, which is very expensive in conversion.

In one embodiment of the invention, the two support axes are coordinated additionally with a wire guide unit located in the direction of travel of the fiber suspension before the dewatering element. The arrangement of wire guide unit and dewatering element on a common lever arm—as previously known from WO 93/122 92—which is supported in the two support axes, which can be formed by support axles, offers the advantage that the entrance gap for the fiber suspension on the dewatering element, the adjustment of which is effected by a positional change of the dewatering element and of the wire guide element located before the respective dewatering element—can be defined exactly.

In the example of a twin-wire former, the entrance gap is the gap formed by the dewatering element with contacting wire and the backing wire, i.e., by the upper-wire box and the lower wire. In variation from known pivot arrangements on which the change of the entrance gap effected by tilting the dewatering element is once again influenced by the independent positional change of the wire guide system and the departure lines of the wires from the wire guide systems change, remain constant in the present invention of the departure line on the wire guide system and the approach line to the dewatering element, based on individual elements—wire guide system and dewatering element. The advantage of this is primarily that the flat working surface of the dewatering element, across the machine width and its length in the direction of travel of the fiber suspension is always completely in contact with the wire. Employed as the wire guide system is preferably a roll, but it is also conceivable to use stationary or adjustable slats or an element with partially curved surface.

BRIEF DESCRIPTION OF THE DRAWINGS

The inventional solution to the problem will hereafter be illustrated in detail with the aid of the figures.

DETAILED DESCRIPTION OF THE INVENTION

Figure 1:
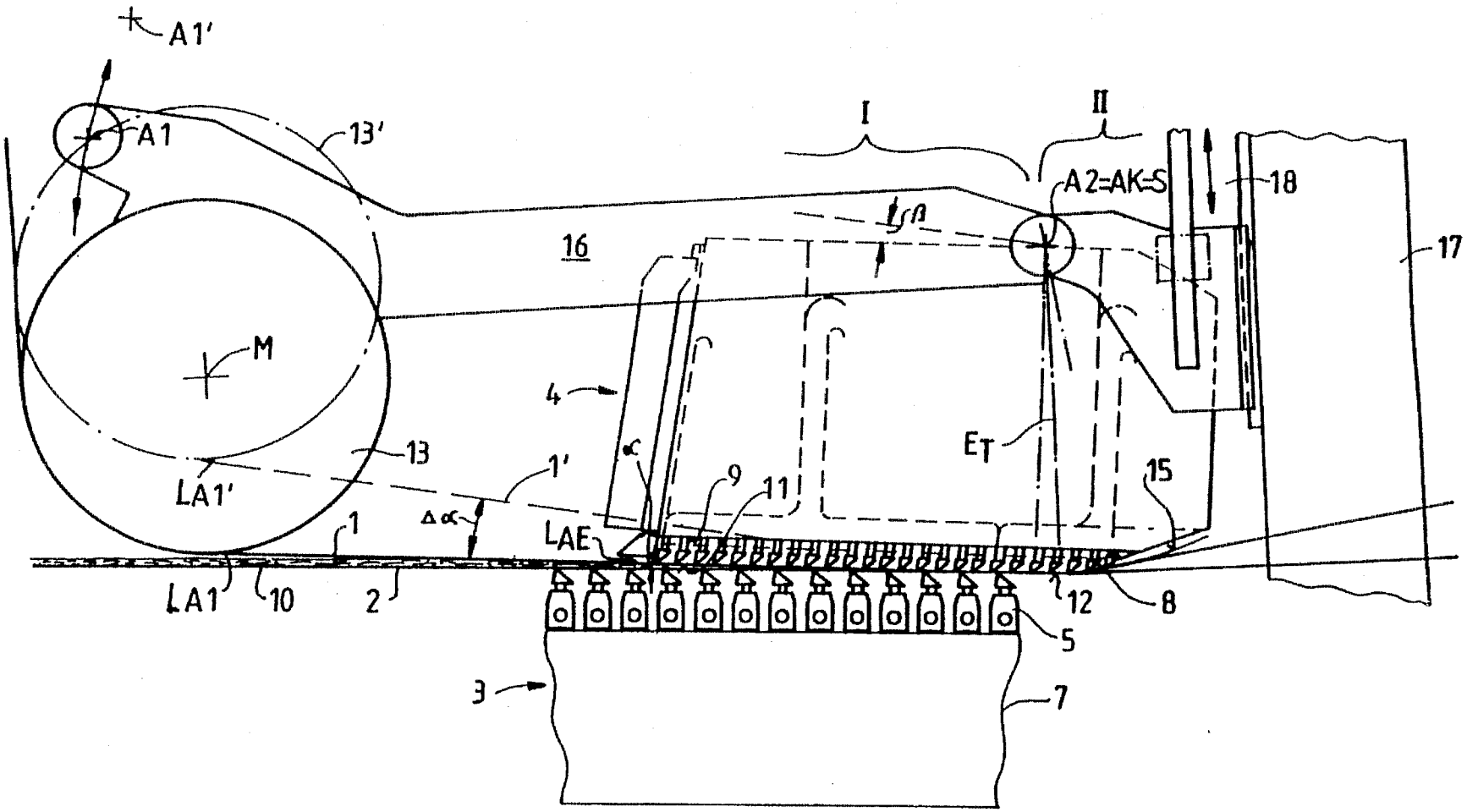
FIG. 1 shows an inventional arrangement of a pivot axis in a twin-wire former where the wire guide system and dewatering element feature two common support axles.

FIG. 1 illustrates a section of a twin-wire arrangement with an integrated dewatering unit. Only partially illustrated here, two continuous wires—a top wire 1 and a bottom wire 2—pass between a lower dewatering box 3 and an upper dewatering box 4. Contained on the lower dewatering box 3 are a number of slats 5 which are flexibly forced on the bottom wire 2 from below. For that purpose, the slats 5 bear through the intermediary of springs or compressed air on a rigid plate 7.

The upper dewatering box 4 features a number of rigid slats 8, which here bear in nonyielding fashion on the underside 9. The upper dewatering box, viewed in the direction of travel of the fiber suspension 10, can be subdivided in two areas which, in interaction with continuous wires 1 and 2, form two dewatering zones. The first dewatering zone I is defined by an essentially flat surface 11, due to the flat surface covered by the slats 8, or the dewatering element 4 fashioned as flat surface on its underside 9. This is interrupted only by suction slots for removal of the liquid drawn from the fiber suspension, which slots are not illustrated in detail here. In the following second dewatering zone II, the arrangement of the slats 8 covers a surface 12 which, while allowing for open spaces between individual slats, curves about an axis of curvature $A_k$ in the direction of travel of the fiber suspension.

The upper dewatering box forms together with a wire guide system 13 an assembly through a lever arm 16. The latter is supported here by bearing elements not illustrated in detail, which are arranged on the support axes $A_1$ and $A_2$—indicated here only for support axis $A_2$—and bear on the machine frame 17. The support axis $A_1$, extends parallel to the separation plane $E_T$ between the straight and curved dewatering zone I and II, and parallel to the fiber suspension 10. The support axes can be formed by support axles, or, for example, by shafts, pins and the like. In the direction of travel, the support axle $A_1$ is mandatorily arranged before the second—in the present example before the first dewatering zone. The support axle $A_2$ is arranged parallel to the plane of separation $E_T$ between straight and curved dewatering zone, and parallel to the curved surface 12 in the direction of travel of the fiber suspension on the underside 9 of the dewatering box 4. The support axle $A_2$ acts here as pivot axis S arranged on the axis of curvature $A_K$. As regards the tilting or pivoting process, i.e., the positional change of the support axle $A_1$, the pivot axis is stationary. Configured as tilt axis for reasons of assembly, the support axle $A_2$ can be adjusted outside the tilting process also by means of a system 18, which is only indicated here.

At least two elements each are preferably arranged on the support axles across the entire machine width, for mounting, or bearing on the machine frame. These elements have a configuration such that, when arranged on the stationary pivot axis, they undergo a fixed coordination with the machine frame, while in the case of arrangement on one of the support axles which is variable in its position, the configuration of these elements is such that a positional change of the support axles can be balanced out by these elements relative to the machine frame, for instance by a lead screw which is mounted both on the support axle and the frame. A shift of the support axle relative to the machine frame can be balanced out without any problems.

The wire guide system 13 is arranged here with the center M offset relative to the lever arm 16. Center M may also be arranged on the lever arm 16.

A change of the entrance gap α occurs in the embodiment by tilting the dewatering element 4 about the pivot axis S, due to shifting the support axle $A_1$ to $A_1'$. Owing to the shift of the support axle $A_1$, the rear, curved part of the dewatering box performs with a stationary pivot axis S a motion along the circular arc 15 described by the radius of curvature r.

At layer thickness reduction, not illustrated here, the front portion of the dewatering box is lowered. The slats 8 arranged on the underside of the dewatering box move then in analogy to the circular arc 15 described by the radius of curvature r, but in the direction of wire travel.

When a direct arrangement of the pivot axis S on the axis of curvature $A_K$ is not possible, an available option is also arranging the pivot axis S in the area of the axis of curvature $A_K$ without completely foregoing the advantages of a pivot axis arrangement on the axis of curvature. When the pivot axis S is not arranged on the axis of curvature $A_K$ but in its area, the rear, curved part of the dewatering box performs only a negligible up and down motion relative to the circular arc 15 described by the radius of curvature r, due to the small pivot angle β required for changing the entrance gap α.

In tilting about the pivot axis S, by tilting the support axle $A_1$ toward $A_1'$, the wire guide system 13 is concomitantly tilted at the same angle, the pivot angle β, as the upper dewatering box 4—new position 13' in dashed illustration. The departure line of the upper wire 1 on the wire guide system 13 $L_{A1}$ and the approach line $L_{AE}$ of the wire on the upper dewatering box 4 remain unchanged as regards the individual elements wire guide system 13 and upper dewatering box 4 (illustrated in the figure only for $L_{A1}$). Illustrated as dashed line as well is the position of the top wire 1 after tilting about the new position corresponds to 1'.

Coupling the upper dewatering box 4 and the wire guide system 13 via a common lever arm 16 offers the advantage that only one adjustment operation needs to be carried out for changing the entrance gap Δα, since the upper dewatering box 4 and wire guide system 13 are tilted about the same pivot axis S jointly by the angle β. The required additional adjustment of the wire guide system 13 in the other case, not illustrated here, is dispensable and thus also any influencing of the entrance gap angle α by incorrect adjustment of the wire guide system 13 and the associated change of the approach line $L_{AE}$ of upper wire I on the dewatering box 4.

The change of the entrance gap Δα illustrated here corresponds to the pivot angle shown in the figure. For reason of clarity, however, only the tilting of the wire guide system 13 is illustrated by dashed line.

Figure 2A:
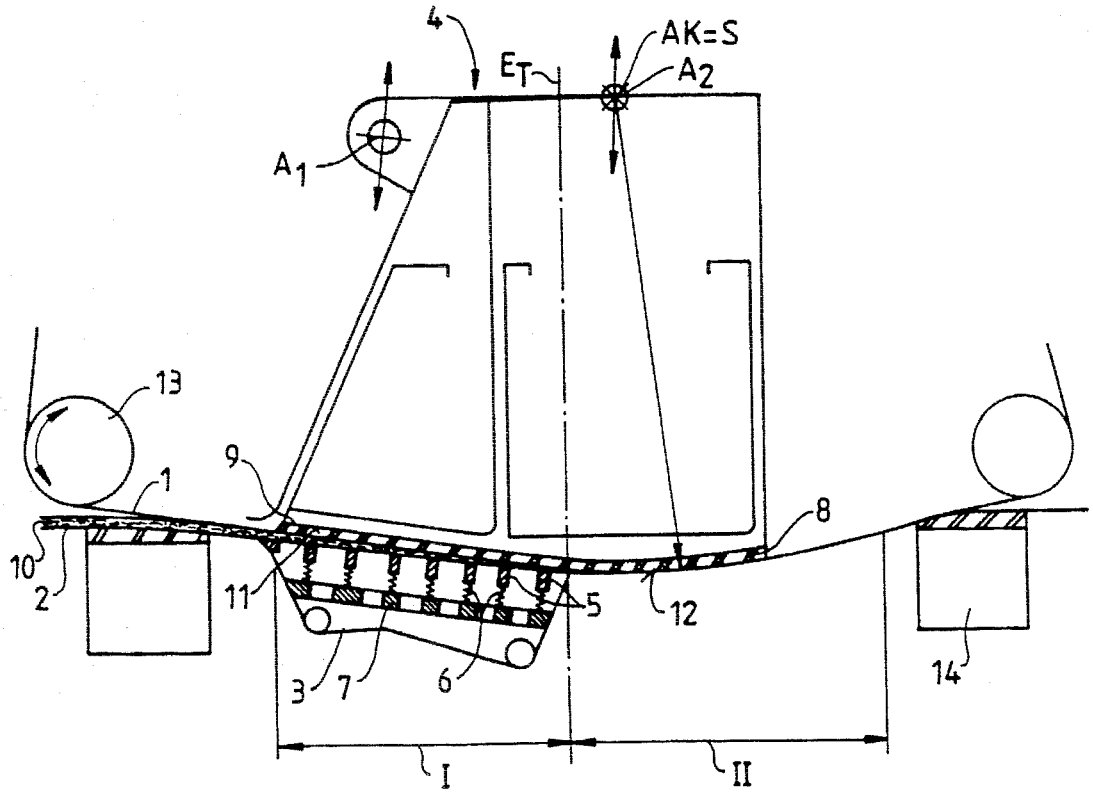
FIG. 2*a* shows an embodiment without direct coupling of the dewatering element to a wire guide system.
Figure 2B:
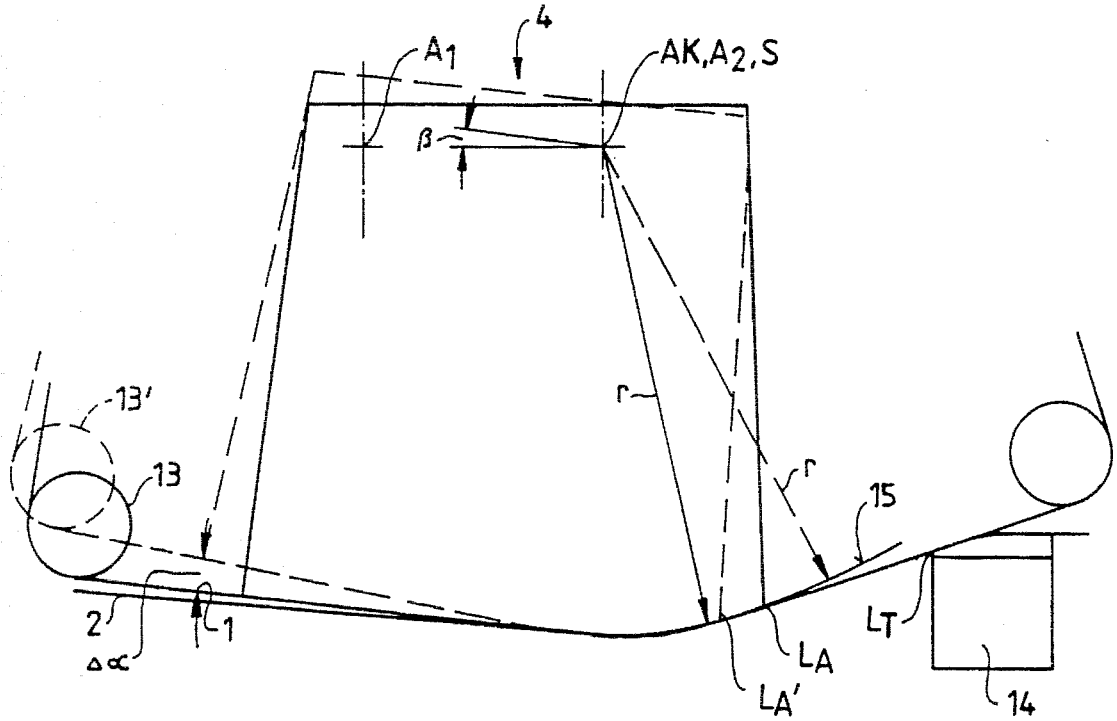
FIG. 2*b* shows schematically, with the aid of the embodiment illustrated in FIG. 2*a*, that the approach lines of the wires on the following suction separator system are essentially retained in tilting about a pivot axis in the area of the axis of curvature.

FIG. 2*a* and 2*b* show an embodiment in which coupling the upper dewatering box 4 to the wire guide system 13 was waived. Otherwise, the basic structure is analogous to that described in FIG. 1, for which reason same references are used for identical elements.

The upper dewatering box 4 is supported here by (not illustrated) elements arranged on the support axles $A_1$ and $A_2$. The support axle $A_1$ extends parallel to the axis of separation $E_T$ between straight and curved dewatering zone I and II and parallel to the fiber suspension 10. The support axle $A_1$ is arranged in the direction of travel before the second dewatering zone. The support axle $A_2$ is arranged parallel to the plane of separation $E_T$ between straight and curved dewatering zone and parallel to the dewatering zone describing a curved surface in the direction of travel of the fiber suspension. The support axle $A_2$ acts here as swivel axis S, arranged on the axis of curvature $A_K$. The pivot axis is stationary in relation to the tilting operation, that is, to the positional change of the support axle $A_1$.

The wire guide system 13 is arranged here detached from the upper dewatering box 4, in the direction of travel of the fiber suspension before the dewatering box 4. It features an adjustment mechanism of its own, which is not illustrated in detail here, but indicated by double arrow.

The two wires are separated from each other at the end of the twin-wire zone by conventional separating systems, here for instance a suction separator system 14.

FIG. 2*b* shows with the aid of the twin-wire former illustrated in FIG. 2*a* (references adopted) schematically how at adaptation to different layer thicknesses between the two wires 1 and 2—by tilting or pivoting the front part of the upper dewatering box 4 about the pivot axis S, which is identical with the axis of curvature $A_K$ and at the same time acts as support axle $A_2$—the departure line $L_A$ of the wires on the upper dewatering box changes ($L_A'$) in its position. Approach line $L_T$ of the wires on the following suction separator system 14 remains unaffected.

At enlargement of the layer thickness, i.e., enlargement the entrance gap α by Δα, the upper dewatering box 4 is tilted about the pivot axis S, which here at the same time represents $A_2$. The slats arranged on the underside of dewatering box 4, while not illustrated in detail here, move along the circular arc 15 described by the radius of curvature r. The wire guide system 13 must be adjusted from its original position to its new position 13', illustrated here by dashed line, when the entrance gap change Δα effected by tilting the upper dewatering box 4 by the tilt angle β is to remain at its size. When the positional change of the wire guide system deviates from it (not illustrated here), i.e., when the connecting line from the departure point on the wire guide system coincides with the approach point on the dewatering element from the extension to the straight part of the dewatering element that would result at complete coinciding of the slats arranged on the underside of the dewatering box 4 in the first dewatering zone with the upper wire 1, the angle of the entrance gap $\alpha$ can be influenced.

When the connecting line between departure point on the wire guide system and approach point on the dewatering element is within the angle that can be described by the extension to the straight part of the dewatering element that results at complete coinciding of the slats arranged on the underside of dewatering box 4 in the first dewatering zone with the upper wire 1 and the lower wire 2, the actual angle of the entrance gap is being reduced. When the connecting line between departure point on the wire guide system 13 and approach point on the dewatering element 4 is outside the angle that can be described by the extension to the straight part of the dewatering element that results at complete coinciding of the slats arranged on the underside of the dewatering box 4 in the first dewatering zone with the upper wire 1, and the lower wire, the angle of the entrance gap remains unaffected, but the wire is highly stressed in the area of the approach line to the dewatering box 4. Very slight variations of the connecting line from the extension to the straight part of the dewatering element, however, may possibly, and depending on application, be desirable and are then negligible in this case.

At reduction of the layer thickness at the entrance (not shown), the front part of the dewatering box is lowered. The slats arranged on the underside of the dewatering box move then in analogy to the circle of arc 15 described by the radius of curvature r, but in the direction of wire travel.

The adaptation to different layer thicknesses requires normally only a slight shift of the, in this case front, support axle $A_1$. With the pivot axis $A_2$ arranged in the area of the curvature center $A_K$, the positional deviation of the slats 8 relative to the circular arc 15 described by the radius of curvature r is therefore negligibly small.

The arrangement of a pivot axis in the area of the axis of curvature, preferably exactly on it, may also be provided with dewatering elements of different design, but which must feature at least one curved surface.

What is claimed is:

1. A wire section of a machine for making a web from a fiber suspension travelling through said machine, comprising:

two continuous wires defining together a twin-wire zone;

a dewatering element having at least one surface which is pressable on the inside of one of said wires, said dewatering element including, in the direction of travel of the fiber suspension, two dewatering zones, said dewatering zones oriented to interact with said at least one of said wires;

a first dewatering zone defining a generally flat surface, and a second dewatering zone defining a surface configured to curve about an axis of curvature in the direction of travel of the suspension;

at least two support axes coordinated with said dewatering element, one of said support axes being tiltable; and a pivot axis coordinated with the dewatering element, wherein another one of said support axes comprises said pivot axis, said pivot axis arranged to be stationary during tilting of said one support axis, said pivot axis extending parallel to a separation plane between the first and second dewatering zones and parallel to at least one of said wires, said pivot axis being arranged in closely spaced relationship to said axis of curvature such that said pivot axis substantially coincides with said axis of curvature.

2. The wire section of claim 1, wherein the pivot axis coincides with the axis of curvature.

3. The wire section of claim 1, in which the support axes are coordinated with a wire guide system, wherein said wire guide system is arranged in the direction of travel of the fiber suspension before the dewatering element; and wherein said dewatering element and wire guide system are coupled together.

4. Wire section of a machine for making a fiber web, with two continuous wires forming together a twin-wire zone, with a dewatering element which can be pressed on the inside of one of the wires with at least one surface, the dewatering element featuring in the direction of travel of the fiber suspension, in interaction with the wires, two dewatering zones, the first dewatering zone being defined by an essentially flat surface, and the second dewatering zone being defined by a surface curving about an axis of curvature in the direction of travel of the fiber suspension, at least two support axes on which support elements are arranged being coordinated with the dewatering element, and a pivot axis coordinated with the dewatering element, wherein the improvement comprises:

a) the pivot axis is stationary as regards a tilting operation of one of said support elements;

b) the pivot axis extends parallel to a separation plane between the first and second dewatering zones and parallel to one of the wires; and c) the pivot axis substantially coincides with the axis of curvature.

* * * * *